US005772395A

United States Patent [19]

Schofield

[11] Patent Number: 5,772,395

[45] Date of Patent: Jun. 30, 1998

[54] VACUUM PUMPS

[75] Inventor: Nigel Paul Schofield, Horsham, Great Britain

[73] Assignee: The BOC Group plc, Windlesham, England

[21] Appl. No.: 762,571

[22] Filed: Dec. 9, 1996

[30] Foreign Application Priority Data

Dec. 12, 1995 [GB] United Kingdom ..... 9525337

[51] Int. Cl.[6] ..... F01D 1/36

[52] U.S. Cl. ..... 415/90; 415/188; 415/192; 415/195; 415/208.5

[58] Field of Search ..... 415/90, 143, 186, 415/188, 192, 195, 208.5, 211.1; 417/423.4

[56] References Cited

U.S. PATENT DOCUMENTS

| | | | |
|---|---|---|---|
| 2,730,297 | 1/1956 | Van Dorsten et al. | 415/90 |
| 3,749,528 | 7/1973 | Rousseau et al. | 415/90 |
| 4,023,920 | 5/1977 | Bächler et al. | 415/90 |
| 4,732,529 | 3/1988 | Narita et al. | 415/90 |
| 4,746,265 | 5/1988 | Luijten | 415/90 |
| 4,806,074 | 2/1989 | Bürger et al. | 415/90 |
| 5,165,872 | 11/1992 | Fleischmann et al. | 415/90 |
| 5,358,373 | 10/1994 | Hablanian | 415/90 |
| 5,553,998 | 9/1996 | Mühlhoff et al. | 415/90 |

FOREIGN PATENT DOCUMENTS

| | | | |
|---|---|---|---|
| 260733 | 6/1987 | European Pat. Off. . | |
| 1010235 | 6/1957 | Germany . | |
| 372164 | 2/1989 | Germany . | |
| 41 13 122 | 10/1991 | Germany . | |
| 0246288 | 9/1992 | Japan | 417/423.4 |
| 135263 | 5/1967 | Netherlands . | |
| 291846 | 4/1951 | Switzerland . | |

*Primary Examiner*—Christopher Verdier
*Attorney, Agent, or Firm*—David M. Rosenblum; Salvatore P. Pace

[57] ABSTRACT

A vacuum pump assembly which comprises at least two cylinders of different diameters and arranged coaxially relative to each other to define an annular space therebetween and a helical member positioned within the space to define a helical path between the cylinders. Rotation of the cylinders is effected relative to the helical member, or vice versa, about their longitudinal axis.

10 Claims, 5 Drawing Sheets

3-5

VACUUM PUMPS

BACKGROUND OF THE INVENTION

This invention relates to vacuum pumps and more particularly to those pumps known as molecular drag pumps.

Molecular drag pumps operate on the general principle that, at low pressures, gas molecules striking a fast moving surface can be given a velocity component from the moving surface. As a result, the molecules tend to take up the same direction of motion as the surface against which they strike, thus urging the molecules through the pump leaving a relatively higher pressure in the vicinity of the pump exhaust.

Types of vacuum pump using the molecular drag mode of operation include "Holweck" pumps in which a helical gas path is defined between two co-axial hollow cylinders of different diameters by means of a helical thread mounted on the inner surface of the outer cylinder or on the outer surface of the smaller diameter cylinder and substantially occupying the space therebetween.

In such Holweck pumps, one cylinder is rotated at high speed about its longitudinal axis and gas present at one end of the helix is urged to move along the helical gas path between the cylinder by means of a molecular drag effect caused by impingement of the gas molecules on the spinning cylinder surface adjacent the gas path; a pumping effect can therefore be established.

Generally in the case of molecular drag pumps, the speeds of rotation of the cylinder are high, for example up to twenty thousand revolutions/minute or more.

The present invention is concerned with an improved pump design which in general utilises a helical member but which generally exhibits higher pumping efficiencies.

SUMMARY OF THE INVENTION

In accordance with the invention, there is provided a vacuum pump assembly which comprises at least two cylinders of different diameters and arranged coaxially relative to each other to define an annular space therebetween and a helical member positioned within the space to define a helical path between the cylinders wherein means are provided to effect rotation of the cylinders relative to the helical member, or vice versa, about their longitudinal axis.

The larger diameter cylinder clearly needs to be hollow to accommodate the one of smaller diameter; preferably the smaller one is hollow also to minimise weight.

Although both the helical member and the cylinders may be rotated, it is usual for only the cylinders or only the helical member to be rotated to effect the relative rotation therebetween.

In preferred embodiments, it is the cylinders which are rotated about a stationary helical member.

The velocity of rotation in all cases can be from ten thousand revolutions per minute up to thirty thousand revolutions per minute or more.

In the case of rotating cylinders, it is usual for them both to rotate at the same velocity and, preferably, they can both be mounted on the same rotor assembly. The cylinders must rotate in the same direction.

In contrast to the known Holweck design in which there is relative movement between the helical component and one cylinder wall surface, the invention provides for relative movement between the helical member and two cylinder wall surfaces, thereby leading to a higher net gas velocity and therefore higher compression through the helix; a higher overall efficiency is thereby achieved.

The cylinders themselves, especially when adapted for rotation can usefully be made from their metal sheet, for example steel or aluminium, or from plastic material or from fibre reinforced material.

One or both "cylinders" may have a tapered cross-section and therefore be more properly described as conical or frusto-conical. All such "cylinders" are, however, included herein in the basic term of cylinder.

In the case of tapered cross-section "cylinders", it is preferably for the annular space cross-section to be larger at the helical gas path inlet and smaller at the outlet to aid pumping efficiency.

In preferred embodiments, the apparatus comprises three or more cylinders, all of which are arranged co-axially with an annular space being defined between adjacent cylinders and a helical member being positioned in each annular space to define a helical path between adjacent cylinders. In such embodiments in particular, it is very preferably for the cylinders to be adapted for rotation and the helical members to be stationary.

In the case of apparatus in which the cylinders are adapted for rotation and irrespective of the number of cylinders present, the apparatus may advantageously possess a helical thread positioned on a pump body component (similar to that of a conventional Holweck design) such that it defines a further helical path between the body component and the outer surface of the outermost cylinder.

With regard to the helical member, this needs to be present in the pump apparatus independently of the cylinders with which it is associated but whose structure is sufficiently close to the relevant walls of each cylinder that the necessary helical gas path is defined therebetween.

There may be only one such gas path but, in order to aid gas throughput and generally to aid pumping efficiency, the helical member preferably defines more than one, for example four, six or eight, gas paths in parallel with each other. In such cases in particular, each gas path can usefully extend for only part of a turn of the "helix" and in reality be regarded simply as part-helical (or arcuate) paths rather than full helical paths.

In preferred embodiments, the pitch of the helix varies along the length of the helical member and is more at the pump inlet than at the pump outlet, i.e. the angle of the helical member component defining a helical path in relation to a plane normal to the longitudinal axis is greater at the inlet to that at the outlet, for example is about 30° at the inlet and is only 15° at the outlet and changes gradually between those angles therebetween.

Two or more stages of pump assembly as described above may be employed in the same vacuum pump. In such cases the subsequent stage(s) may be mounted on the same rotor or on a separate rotor, preferably the former.

Pump assemblies of the invention may be used as "stand alone" vacuum pumps or may usefully be used in conjunction with other pump mechanisms in the same pump body or with separate pumps.

For example, an inlet impeller can be added across the inlet to the helical path(s) to assist in urging the gas molecules through the inlet, especially during molecular flow, and thereby increase pumping speed. Such an impeller could be very similar to the top stage of a turbomolecular pump and comprise co-planar, circular arrays of blades adapted for rotation with the main pump rotor (cylinders or helical member), preferably at the same speed as the main pump rotor and advantageously mounted on the same rotor.

As a further example, conventional Holweck or Siegbahn stages may be used at the pump assembly outlet to increase the net compression ratio.

An added stage at the outlet could also be a regenerative stage or stages in which, in particular, blades mounted on a flat surface or surfaces or on the peripheral edge of a rotating disc urge gas molecules through passageways defined about the volumes associated with the rotating blades. The use of such a regenerative stage can generally allow the pump as a whole to exhaust directly to atmospheric pressure.

BRIEF DESCRIPTION OF THE DRAWINGS

For a better understanding of the invention, reference will now be made, by way of exemplification only, to the accompanying drawings in which.

DETAILED DESCRIPTION

Figure 1:
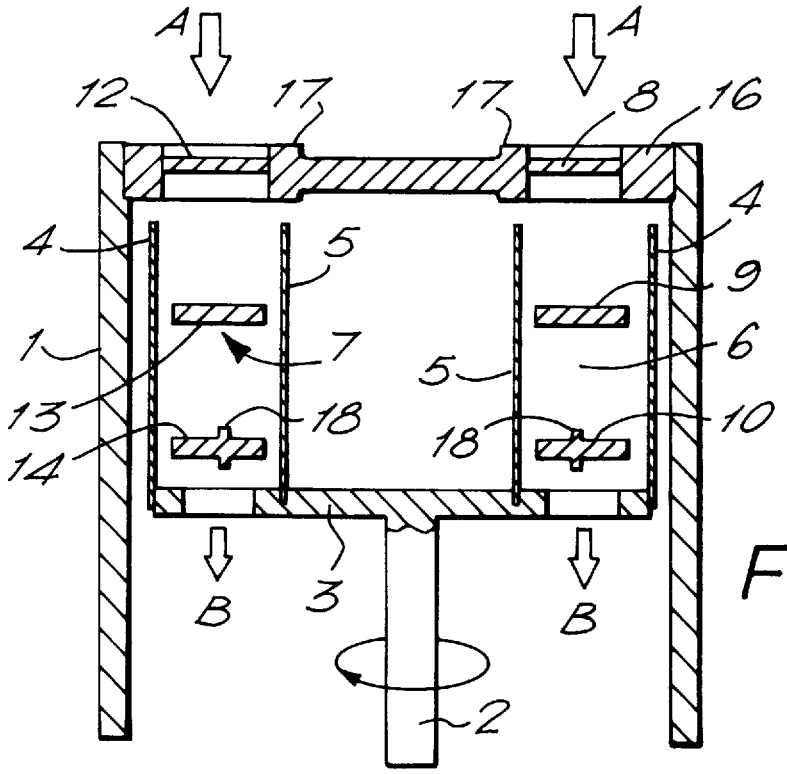
FIG. 1 is a schematic, sectional representation of a vacuum pump assembly of the invention employing two rotating cylinders.

With reference to the drawings, FIG. 1 shows a vacuum pump assembly of the invention in its simplest form. It comprises a pump body 1 within which is mounted for rotation therein about its longitudinal axis a shaft 2 to the upper end (as shown) of which is attached a circular disc 3.

The disc 3 supports at their lower ends (as shown) two hollow cylinders 4,5 arranged co-axially relative to each other. The cylinders 4,5 are fixed to the disc 3 in a manner which allows them to retain their cylindrical shape during rotation at high speed of the disc/cylinders combination.

Figure 2:
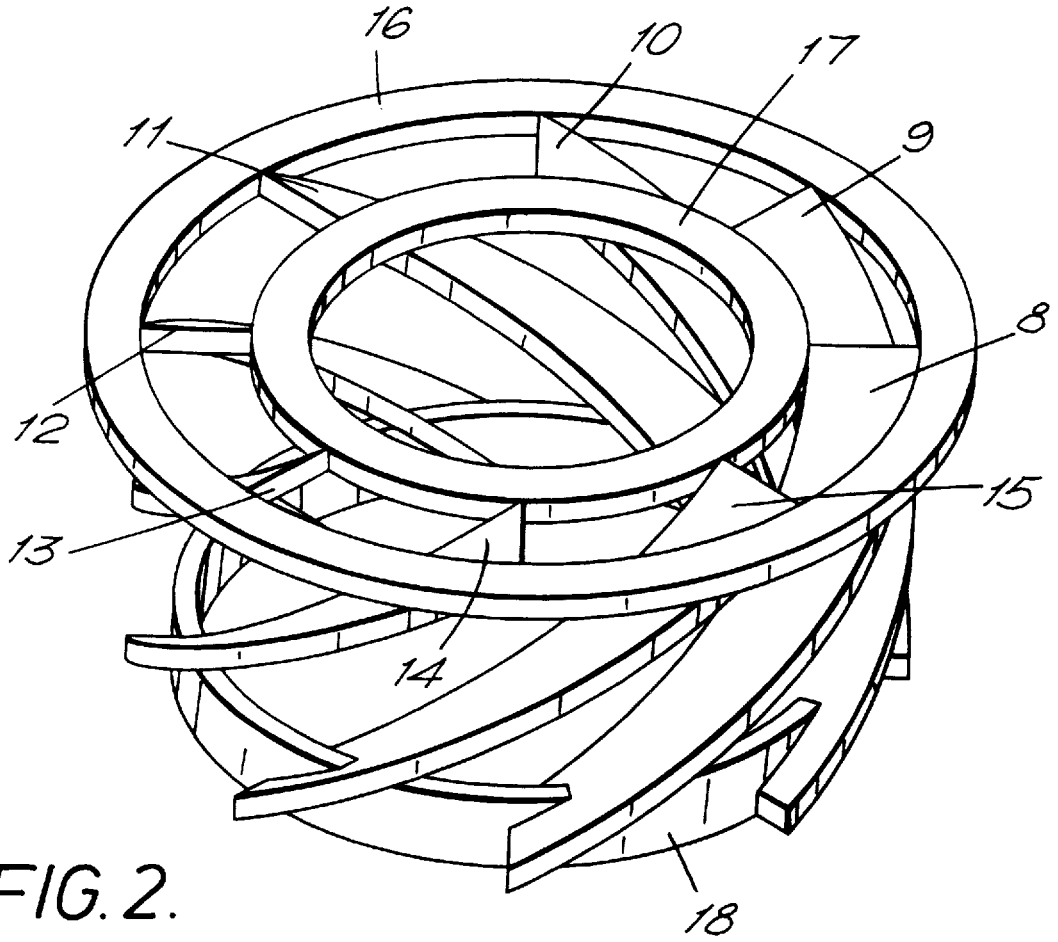
FIG. 2 is a schematic representation of a helical member of the assembly shown in FIG. 1.

The cylinders 4,5 define an annular space 6 therebetween within which is positioned a stationary helical member 7 of a shape shown (not to scale) in FIG. 2. The helical member 7 has eight individual part-helical gas paths therethrough defined by the walls of the cylinders 4,5 and the individual helical member components 8,9,10,11,12,13,14,15. The spacing between the cylinder walls and the helical member components is as small as possible without incurring any direct contact therebetween in use.

A support ring 16 of the helical member forms part of the top of the pump body 1 as does a further support ring 17. The helical member also has a lower support ring 18.

The helical member is therefore positioned in the pump body 1 relative to the cylinders 4,5 in the manner shown in FIG. 1 with the individual inlets to the part helical gas paths being aligned with the top of the pump body.

In use of the pump assembly the shaft 2 is caused to rotate at, for example, thirty thousand revolutions per minute by motor means (not shown) thereby causing rotation of both cylinders 4,5 at the same speed. Gas molecules are drawn in to the part helical gas paths in the direction shown by the arrows 'A' and urged through the gas paths in the manner described above to exit the helical member at eight individual outlets and through exhaust apertures in the disc 3 to connect to a pump assembly outlet (not shown) in the direction of the arrows 'B'.

Figure 3:
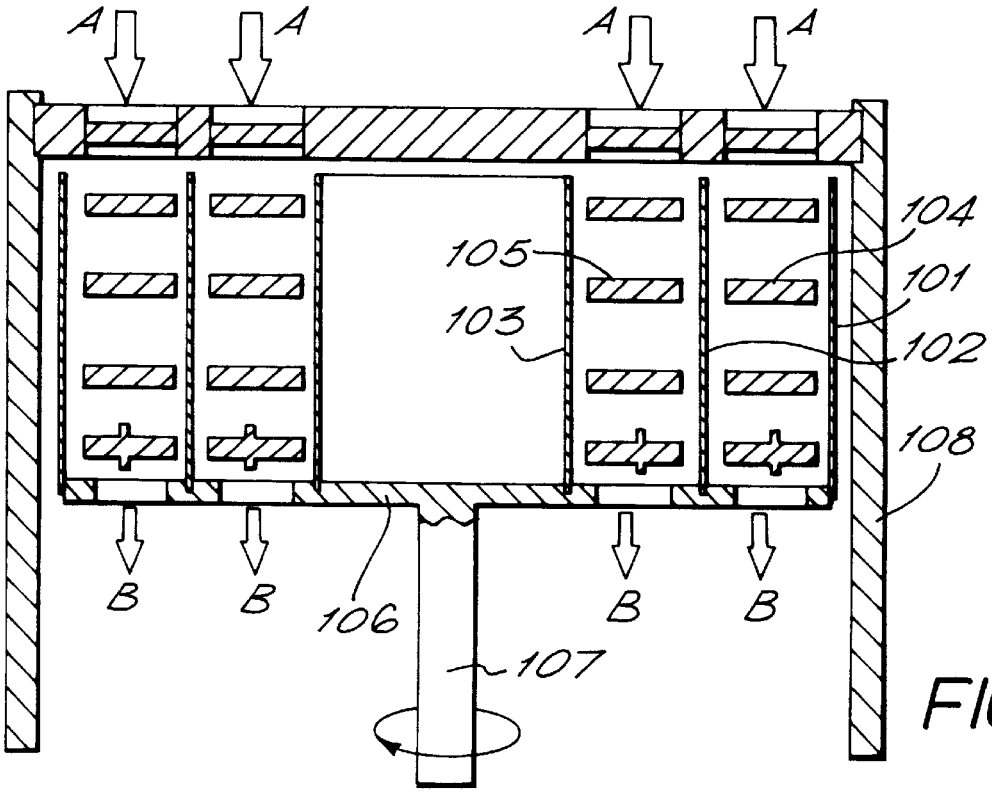
FIG. 3 is a schematic sectional representation of a vacuum pump assembly of the invention employing three rotating cylinders.

Turning to FIG. 3, there is shown a pump assembly of the same basic type as that shown in FIG. 1 but with three rotatable hollow cylinders 101,102,103 within which are positioned two helical members 104,105.

The helical members 104,105 are of the same type of structure to that shown in FIG. 2 but each of the passageways defined therein by means of helical member components and the adjacent walls of two of the three cylinders.

As with the assembly shown in FIG. 1, the cylinders are fixed at their base (as shown) to a disc 106 which is itself mounted on a shaft 107 adapted within a pump body 108 for rotation at high speed.

The helical members are held in position within the top of the pump body and supported therein in the same manner as with the assembly of FIG. 1.

The pump assembly of FIG. 3 therefore possesses individual inlets associated with each of the two helical members; the gas flow being indicated by arrows A and B.

Figure 4:
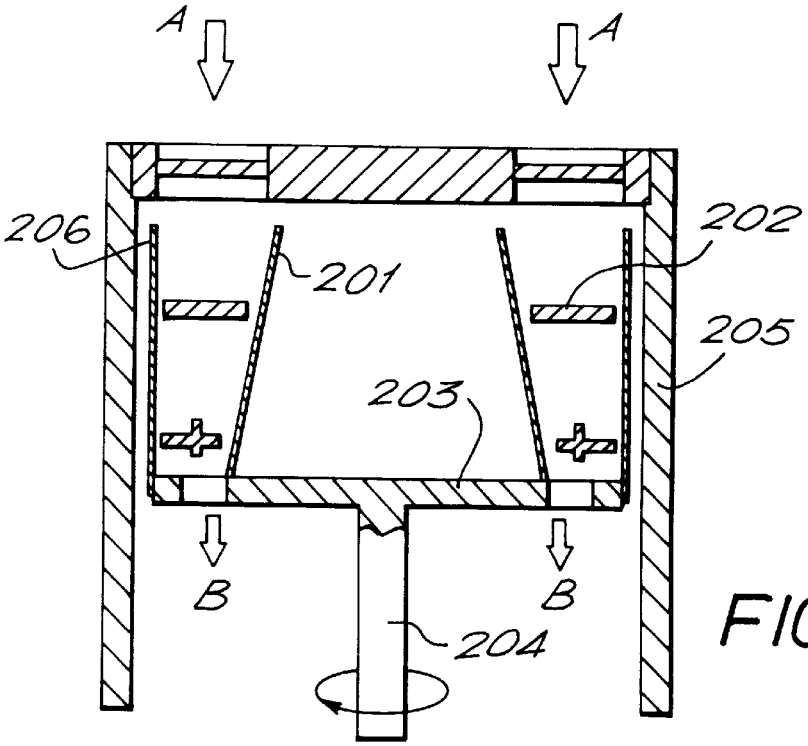
FIG. 4 is a schematic sectional representation of a vacuum pump assembly of the invention employing a conical "cylinder".

FIG. 4 shows the same type of pump assembly as that shown in FIG. 1 except for the use of a hollow tapered cylinder 201 (as the inner of two cylinders) and corresponding shaped helical member 202.

The mounting of the cylinder 201 on a disc 203 attached to a shaft 204 and the support of the helical member 202 within a top portion of a pump body 205 is all essentially the same to that described with reference to the assembly of FIG. 1.

An advantage of the use of a tapered cylinder is that the part-helical gas passageway defined between the cylinder 201 and the outer cylinder 206 and the helical member 201 is broader at the inlet than at the outlet and therefore a greater gas throughput is possible together with a greater compression ratio of gas passing between the arrows 'A' and the arrows 'B'.

Figure 5:
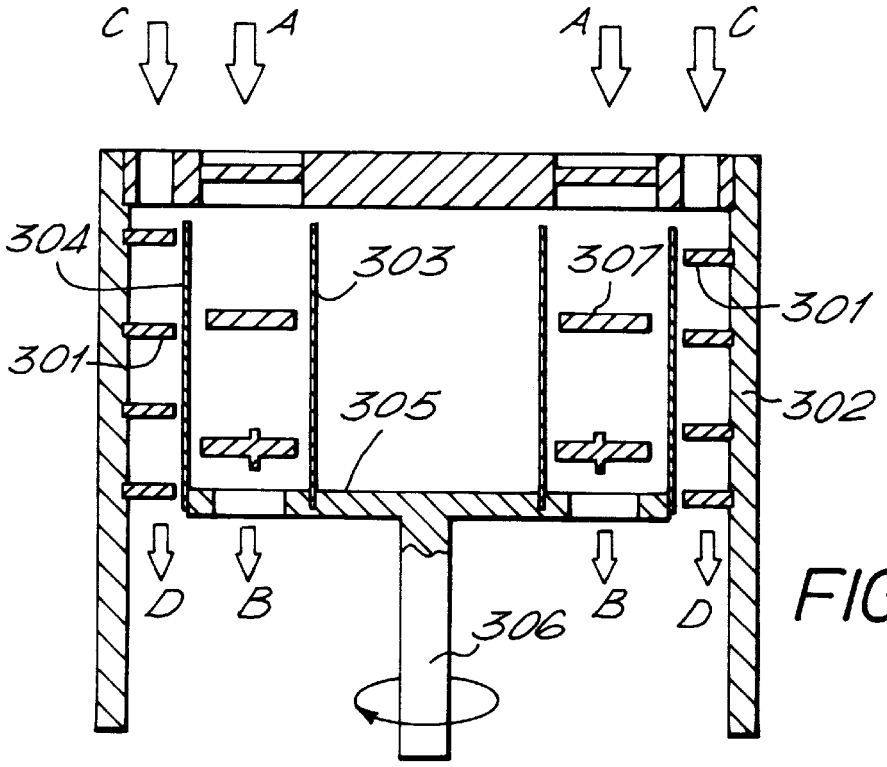
FIG. 5 is a schematic sectional representation of a vacuum pump assembly of the invention employing a standard Holweck helical component on the pump body.

FIG. 5 also shows a pump assembly as the same basic type as that shown in FIG. 1 but with the addition of a 'Holweck' helical thread 301 on the inside surface of the cylindrical pump body 302.

Again the mounting of two cylinders 303,304 on a disc 305 which is itself attached to a shaft 306 and the positioning of a helical member 307 between the cylinders and held within a top portion of the pump body 302 is essentially the same as the construction of the assembly of FIG. 1.

The presence of the Holweck stage in the form of the thread 301 (and its close positioning to the outside surface of the cylinder 304) again allows for a greater pump efficiency and greater gas throughput via the individual passageways defined by the helical member 307 (in the direction of Arrows 'A' and 'B') and via the further passageway defined by the helical thread 301 (in the direction of the Arrows C and D).

Figure 6:
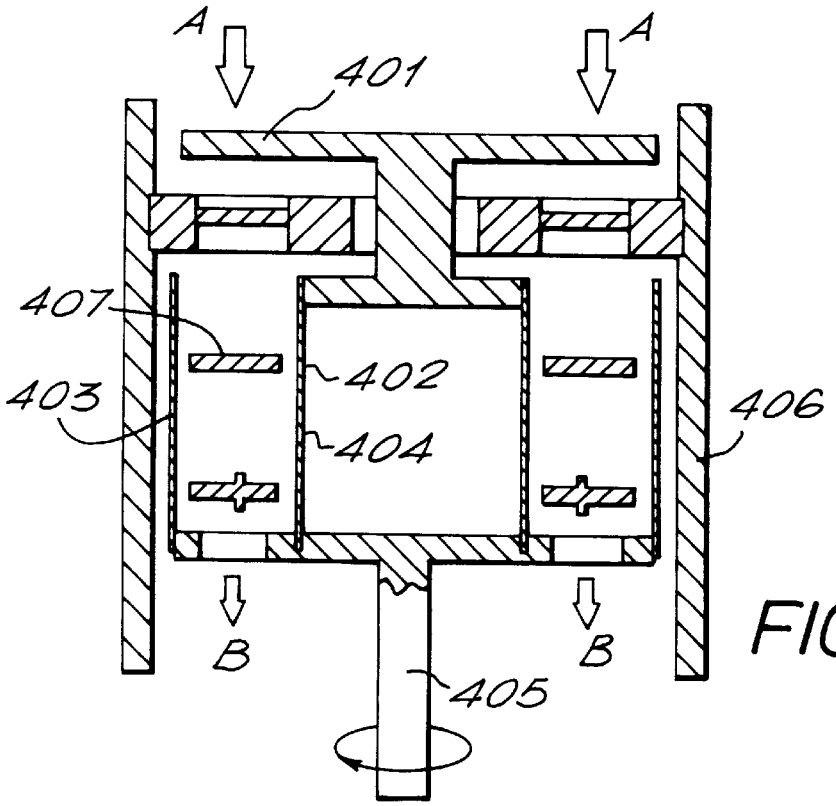
FIG. 6 is a schematic sectional representation of a vacuum pump assembly of the invention employing an impeller at the inlet.

FIG. 6 again shows a pump assembly of the same type as that shown in FIG. 1 but with the addition of an impeller 401 mounted on the top (as shown) of the inner of two cylinders 402,403 which are themselves both mounted on a disc 404 attached to a shaft 405 adapted for rotation at high speed within a pump body 406.

A helical member 407 is again present to define a part-helical pathway between the two cylinders 402,403 and is held in a top portion of the pump body 406 in a similar manner to that of FIG. 1.

The impeller 401 fits closely (without touching) within an upper extension of the pump body 406. The impeller is similar to the top stage of a turbo pump and comprises a co-planar circular array of blades.

Such an impeller is useful to assist in urging gas molecules in to the pump in the direction of the arrows 'A' and 'B'.

Figure 7:
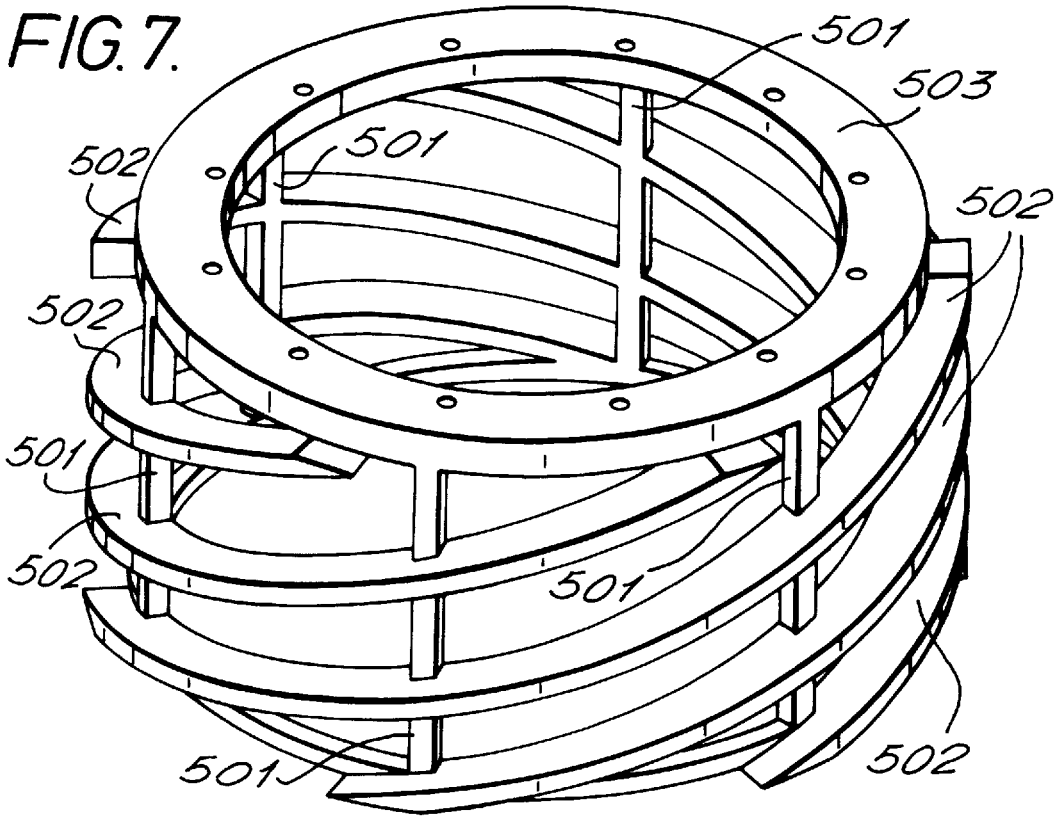
FIG. 7 is a schematic representation of a further helical member for use with an assembly of the invention.

Finally, FIG. 7 shows a further helical member for use with an assembly of the invention. This comprises vertical stiffening members 501 linking the top and bottom of the helix and being attached to individual helical member 502. Such an arrangement allows in general the use of longer helical paths without causing the member as a whole to become too flexible. In this member, only an inner support ring 503 is employed with no external support ring equivalent to the ring 16 of the member shown in FIG. 2.

In the member shown in FIG. 7, there are the same number of vertical stiffening members 501 as there are individual helical members 502 (six of each). There may however be more or less of either depending on the required stiffness of the helical member as a whole.

In all types of pump assembly of the invention, it is preferred to rotate the shaft, and hence the cylinders at a speed of up to thirty thousand revolutions per minute or more.

I claim:

1. A vacuum pump assembly comprising:

at least two cylinders of different diameters and arranged coaxially relative to each other to define an annular space therebetween;

a helical member positioned within the annular space, the helical member formed by individual helical components positioned to define individual, part-helical gas paths within the annular space; and means for effecting relative rotation of the at least two cylinders and the helical member about their longitudinal axes.

2. The vacuum pump assembly according to claim 1 in which the at least two cylinders are hollow.

3. The vacuum pump assembly according to claim 1 or claim 2 in which the at least two cylinders are rotated and the helical member is stationary.

4. The vacuum pump assembly according to claim 1 in which the relative rotational speed is from ten thousand to thirty thousand revolutions per minute.

5. The vacuum pump assembly according to claim 1 comprising at least three cylinders, all of which are arranged co-axially with an annular space defined between adjacent cylinders and a helical member positioned in each annular space.

6. The vacuum pump assembly according to claim 1 in which the at least two cylinders are adapted for rotation and possessing a helical thread positioned in a pump body component such that a further helical path is defined between the body component and the outer surface of the outermost cylinder.

7. The vacuum pump assembly according to claim 1 in which the helical member defines one gas path between the at least two cylinders.

8. The vacuum pump assembly according to claim 1 in which more than one gas path is defined between the at least two cylinders.

9. The vacuum pump assembly according to claim 1 in which the pitch of the helical member varies along its length and is greater at an inlet to said vacuum pump assembly than at an outlet thereof.

10. The vacuum pump assembly according to claim 1 further comprising an impeller at an inlet to said vacuum pump assembly.

* * * * *